United States Patent [19]

Fogg et al.

[11] Patent Number: 5,009,614

[45] Date of Patent: Apr. 23, 1991

[54] SHIELDED CABLE ASSEMBLY WITH FLOATING GROUND

[75] Inventors: Michael W. Fogg, Harrisburg; Keith S. Koegel, Linglestown; John R. Shuey, Mechanicsburg; William E. Zelko, Dauphin; Robert E. Beamenderfer, Palmyra, all of Pa.

[73] Assignee: AMP Incorporated, Harrisburg, Pa.

[21] Appl. No.: 531,203

[22] Filed: May 31, 1990

[51] Int. Cl.[5] ..... H01R 9/07

[52] U.S. Cl. ..... 439/497; 439/736; 439/695

[58] Field of Search ..... 439/92, 95, 101, 108, 439/607-610, 578-585, 492, 494, 497, 498, 499, 736, 686, 695

[56] References Cited

U.S. PATENT DOCUMENTS

| | | | |
|---|---|---|---|
| 2,804,601 | 8/1957 | Harthman et al. | 439/579 |
| 4,386,814 | 6/1983 | Asick | 439/95 |
| 4,416,501 | 11/1983 | Fusselman et al. | 439/580 |
| 4,701,139 | 10/1987 | Good et al. | 439/607 |
| 4,708,666 | 11/1987 | Fisher, Jr. | 439/580 |
| 4,781,615 | 11/1988 | Davis et al. | 439/395 |
| 4,834,674 | 5/1989 | Beamenderfer et al. | 439/494 |
| 4,842,542 | 6/1989 | Davis | 439/357 |
| 4,875,877 | 10/1989 | Fleak et al. | 439/497 |

*Primary Examiner*—David L. Pirlot

*Attorney, Agent, or Firm*—Gerald K. Kita

[57] ABSTRACT

An electrical cable assembly (1) includes: an insulative housing block (20), conductive electrical contacts (9) on the housing block (20) connected to corresponding signal wires (5) of a cable (2), a conductive ground bus (7) connected to corresponding ground wires (4) of the cable (2), a conductive shell (35) enclosing the housing block (20), the ground bus (7) being enclosed by the conductive shell (35) and isolated electrically from the shell (35), and the ground wires (4) extending into the shell (35) and being isolated electrically from the shell (35).

8 Claims, 5 Drawing Sheets

SHIELDED CABLE ASSEMBLY WITH FLOATING GROUND

FIELD OF THE INVENTION

The invention relates to a shielded cable assembly having a metal shell for connection to shielded electrical cable.

BACKGROUND OF THE INVENTION

A shielded cable assembly known from U.S. Pat. No. 4,781,615, includes: an insulative housing block containing electrical contacts for connection to corresponding signal wires of an electrical cable, a conductive shield enclosing the signal wires, and a conductive shell providing shielding for the insulative housing block. The conductive shell is connected to the shielding for the signal wires of the cable. The cable is used, for example, to interconnect electrical and electronic circuits. The circuits are mounted within a chassis that itself includes a shield for diverting EMI and RFI interference through the chassis and away from the circuits. The conductive shell and the chassis are electrically connected, such that the shell is subject to the electrical potential of the chassis, known as chassis ground.

Another known cable assembly disclosed in U.S. Pat. No. 4,875,877, includes electrical contacts in an insulative housing block connected to signal wires of a corresponding electrical cable, and ground wires of a corresponding electrical cable connected to a ground bus.

A need exists for a conductive shield over the insulative housing block to prevent the electrical contacts from emanating and absorbing RFI and EMI interference. The shield should be coupled to the chassis to divert the RFI and EMI interference to the chassis. The ground bus and the ground wires of the cable should be isolated electrically from the chassis to prevent transient high voltage of the chassis from being transmitted by the ground wires of the cable and inducing an undesired voltage in the signal wires.

SUMMARY OF THE INVENTION

A cable assembly for at least one electrical cable includes an insulative housing block, conductive electrical contacts on the housing block connected to corresponding signal wires of the cable, a conductive ground bus connected to corresponding ground wires of the cable, a conductive shell enclosing the housing block, the ground bus being enclosed by the conductive shell and isolated electrically from the shell, and the ground wires extending into the shell and being isolated electrically from the shell. An advantage of this structure is to prevent high voltage of the chassis from being transmitted by the ground wires.

A further understanding of the invention will be obtained from the following detailed description of the invention with reference by way of example to the accompanying drawings.

Figure 1:
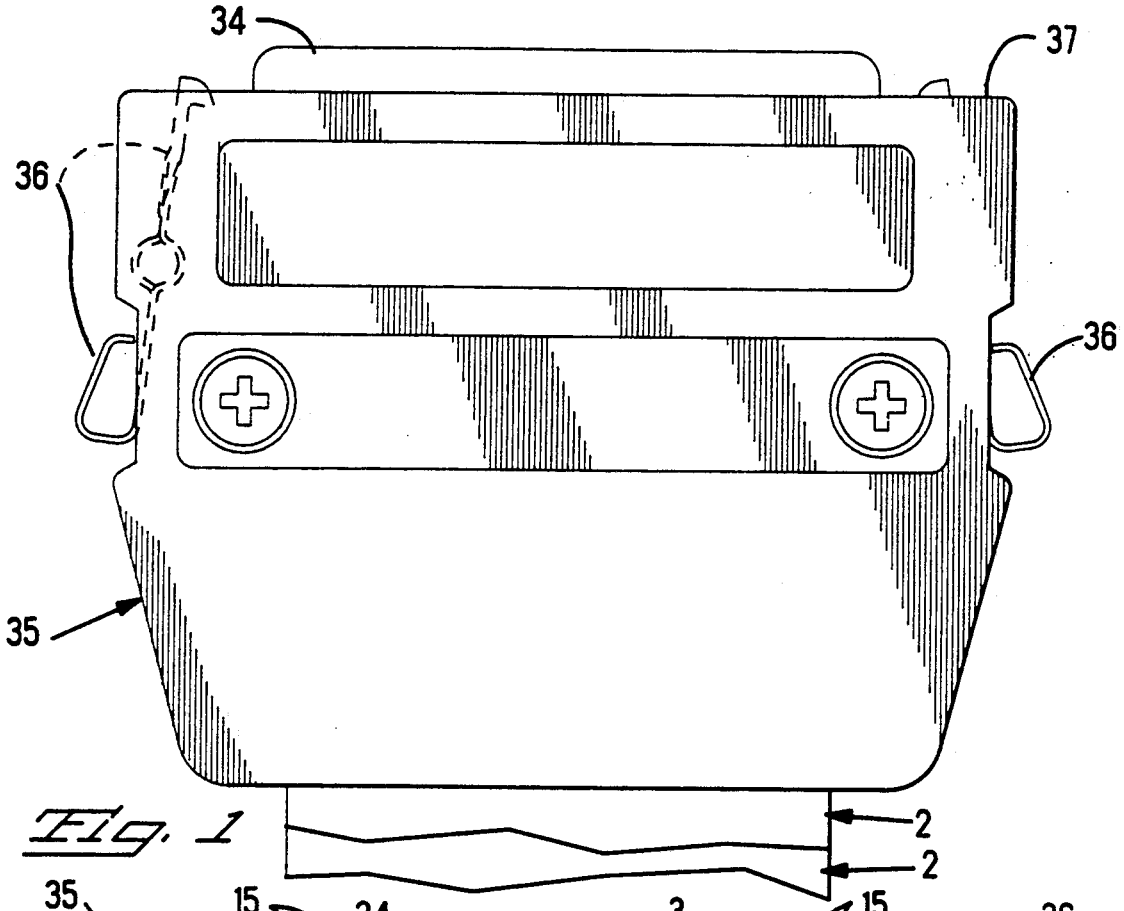
FIG. 1 is an elevation view of a cable assembly.
Figure 2:
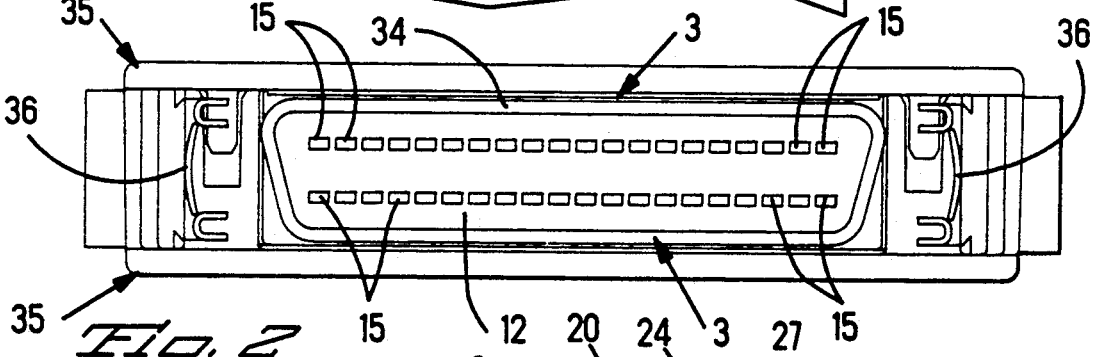
FIG. 2 is a plan view of the cable assembly shown in FIG. 1.
Figure 19:
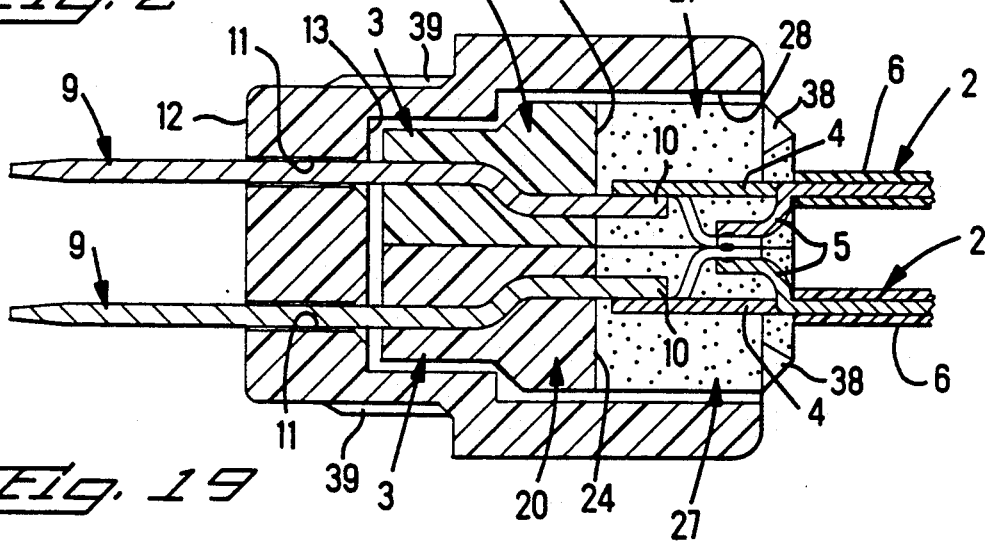
FIG. 19 is an enlarged section view of two housing blocks shown in FIG. 5 secured to respective electrical cables and mounted in the housing shown in FIG. 16.

With further reference to the drawings, there is shown in FIGS. 1, 2 and 19, an electrical cable assembly 1 of an electrical cable 2 connected at each of its ends with an electrical connector assembly 3. The cable 2 shown in FIG. 4B includes parallel elongated signal wires 4 spaced apart from each other on a pitch spacing, and parallel elongated ground wires 5, spaced apart from each other on a pitch spacing. The ground wires 5 are provided for connection to a reference electrical potential known collectively as ground potential. The signal wires 4 are provided for transmitting electrical signals, except for one or more of the signal wires 4 that are selected for connection to ground potential. The wires 4,5 are arranged in an order such that each signal wire 4 is between a pair of ground wires 5, the wires 4,5 are coplanar and spaced apart from each other and a planar and bendable jacket 6 of insulative material encircles each of the wires 4,5. The order of the wires 4,5 and their distances apart from each other, and the dielectric properties of the jacket 6 are unvaried along the length of the cable 2 such that a characteristic impedance of the cable 2 is maintained throughout its length.

Figure 3A:
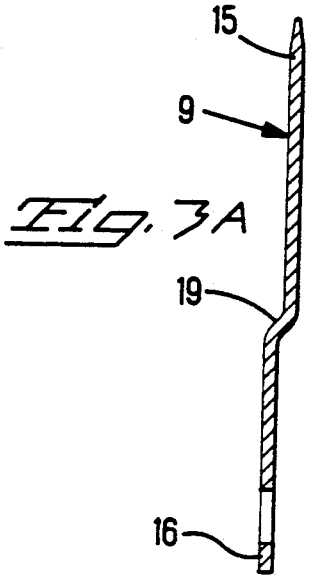
FIG. 3A is a section view taken along the line 3A—3A of FIG. 3.
Figure 3:
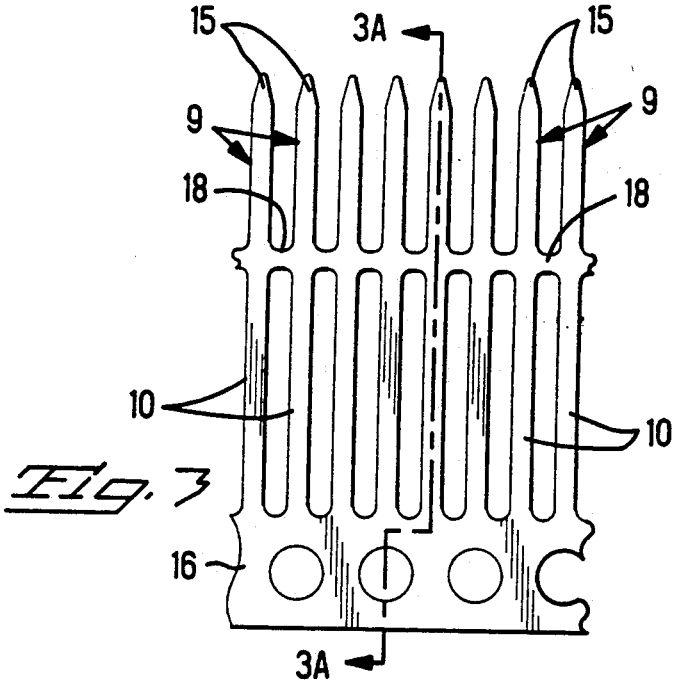
FIG. 3 is an elevation view of a strip of electrical contacts.
Figure 4A:
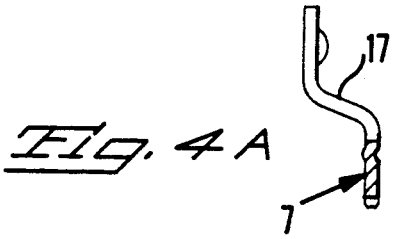
FIG. 4A is a section view taken along the line 4A—4A of FIG. 4.
Figure 4:
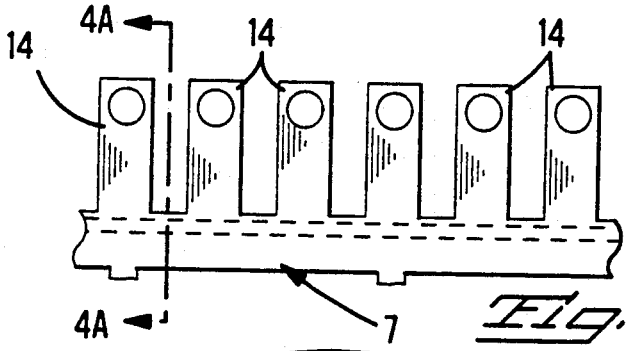
FIG. 4 is an elevation view of a ground bus.
Figure 4B:
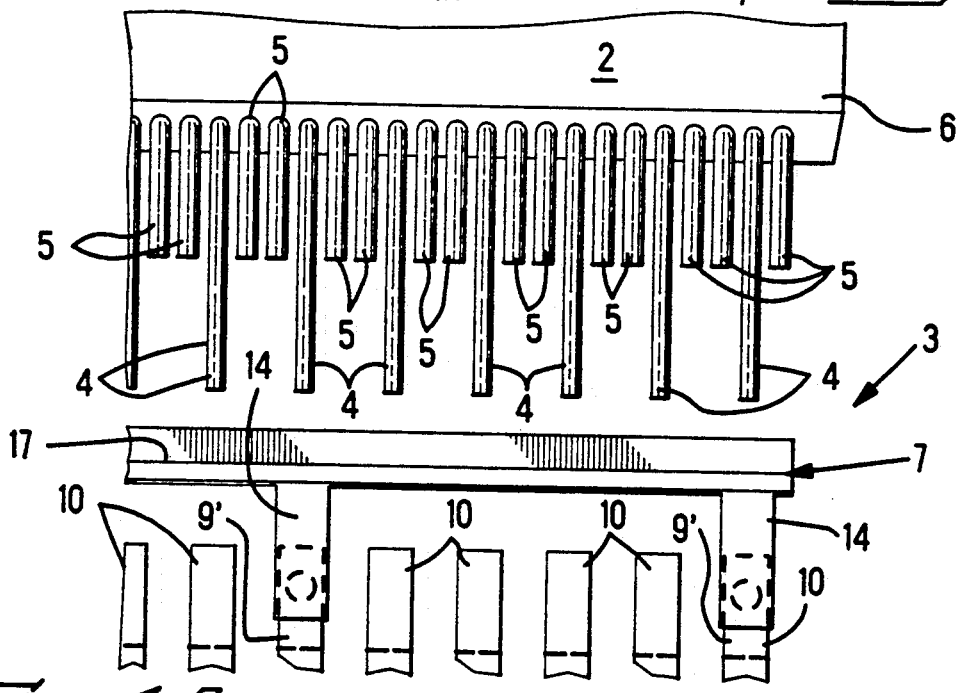
FIG. 4B is a fragmentary enlarged view of a cable and ground bus and signal contacts.
Figure 7:
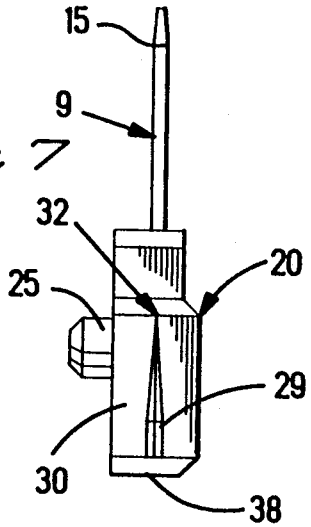
FIG. 7 is an end view of the structure shown in FIG. 5.

The electrical connector assembly 3 comprises, a conductive ground bus 7, FIGS. 4, 4A and 4B, for connection to corresponding ground wires 5 projecting from the cable jacket 6, an insulative housing 8, FIGS. 12, 13, 15 and 19, and conductive electrical contacts 9, FIGS. 3, 3A, 5, 6, and 9, having corresponding wire connecting portions 10 for connection to corresponding signal wires 5 projecting from the cable jacket 6.

The housing 8, FIGS. 11, 12, 13, 15 and 19, includes a rigid plastic portion provided with two rows of axially elongated, contact receiving cavities 11 communicating with a front wall 12 of the housing 8 and with a rear interior wall 13.

The ground bus 7, FIGS. 4, 4A, 4B and 19, is of unitary metal construction and provides conductive, spaced apart tabs 14 that are in a row and in a corresponding plane. The tabs 14 are spaced apart with a pitch spacing correspondingly the same as the pitch spacing of the spaced apart wire connecting portions 10 of the contacts 9.

With reference to FIG. 4B, assembly of the ground bus 7 to the contacts 9 will be described. One or more of the contacts 9 are selected as ground contacts 9' to connect the ground bus 7 to ground potential. Selected tabs 14 are removed from the ground bus 7. Other selected tabs 14 that remain connected to the ground bus 7 are placed to overlie the wire connecting portions 10 of the ground contacts 9'. The tabs 14 are connected to the wire connecting portions 10 of the ground contacts 9', for example by welding or soldering, such that the ground contacts 9' are connected to the ground bus 7.

Opposite sides of the wire connecting portions 10 are exposed to permit clamping of the wire connecting portions 10 between a pair of conventional electrodes, not shown, used for welding or soldering. Further the opposite sides of the wire connecting portions 10 are exposed to facilitate connection of a corresponding tab 14 selectively to one of the sides. The tabs 14 have an offset portion 17, FIG. 4A, to offset the bus bar 7 away from the plane of the wire connecting portions 10 of the contacts 9.

As shown in FIG. 4, the ground bus 7 is of strip configuration. The strip configuration extends transversely of the housing 8 and provides wire connecting portions therealong to which corresponding ground wires 5 are connected. To facilitate assembly of the ground wires 5 to the ground bus 7, the wire connecting portions of the ground bus 7 are in a row and are in a corresponding plane of the ground bus 7. Further, the wire connecting portions of the ground bus 7 are located with a pitch spacing correspondingly the same as the pitch spacing of the ground wires 5 of the cable 2. The ground wires 5 are cut to a common length, simultaneously overlaid upon the coplanar wire connecting portions of the ground bus 7 and connected to the wire connecting portions in one joining operation, for example, by welding or soldering. Wire connections of the ground wires 5 are formed by the joining operation.

Opposite sides of the wire connecting portions of the ground bus 7 are exposed, and thereby permit clamping of the wire connecting portions between a pair of conventional electrodes, not shown, to be used for welding or soldering the ground wires 5 to the ground bus 7.

Figure 8:
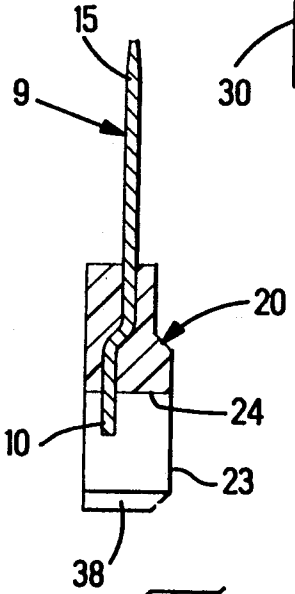
FIG. 8 is a section view taken along the line 8—8 of FIG. 5.
Figure 6:
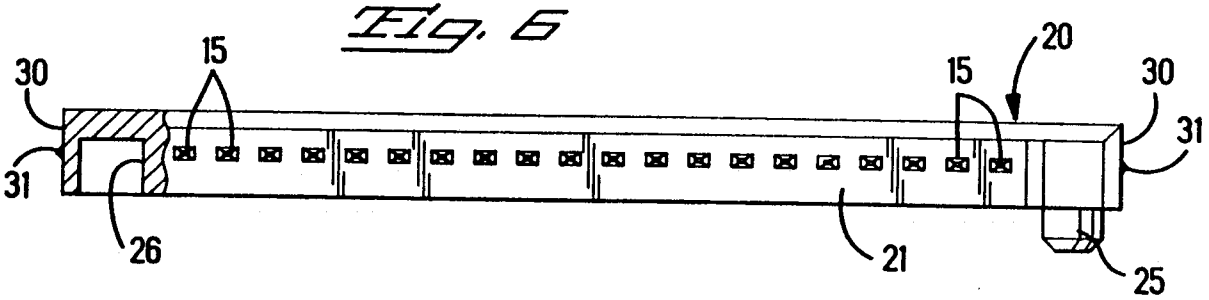
FIG. 6 is a top plan view of the structure shown in FIG. 5.
Figure 5:
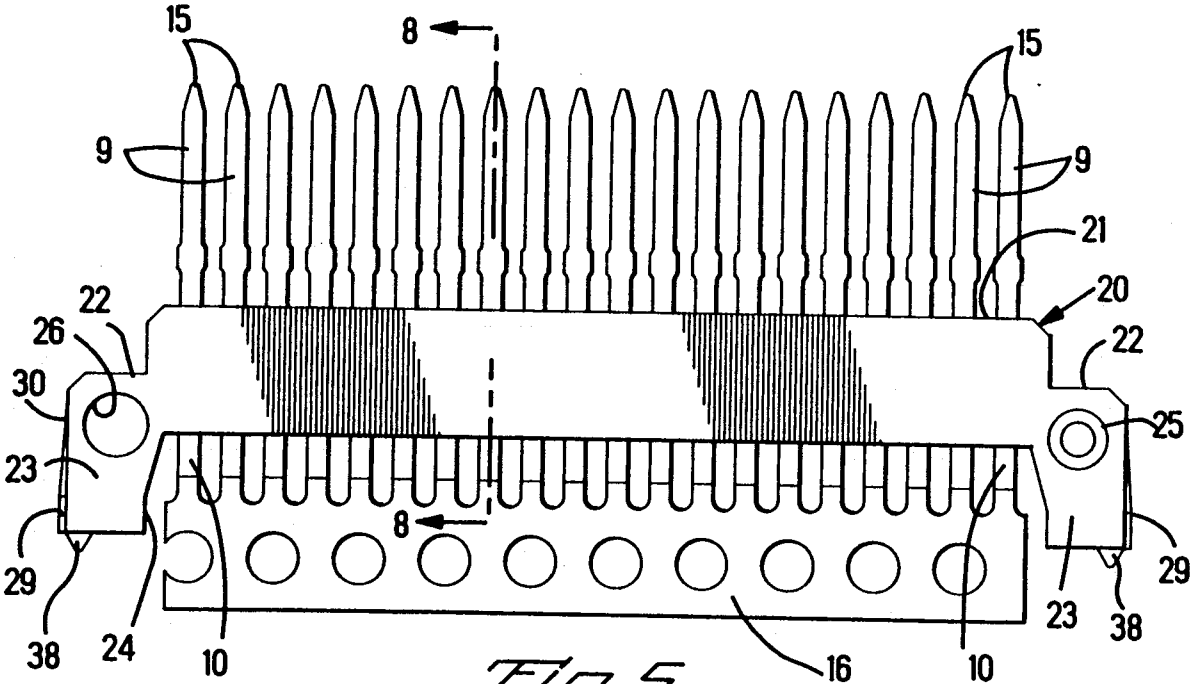
FIG. 5 is an elevation view of the strip of contacts shown in FIG. 3 carried by a housing block.
Figure 9:
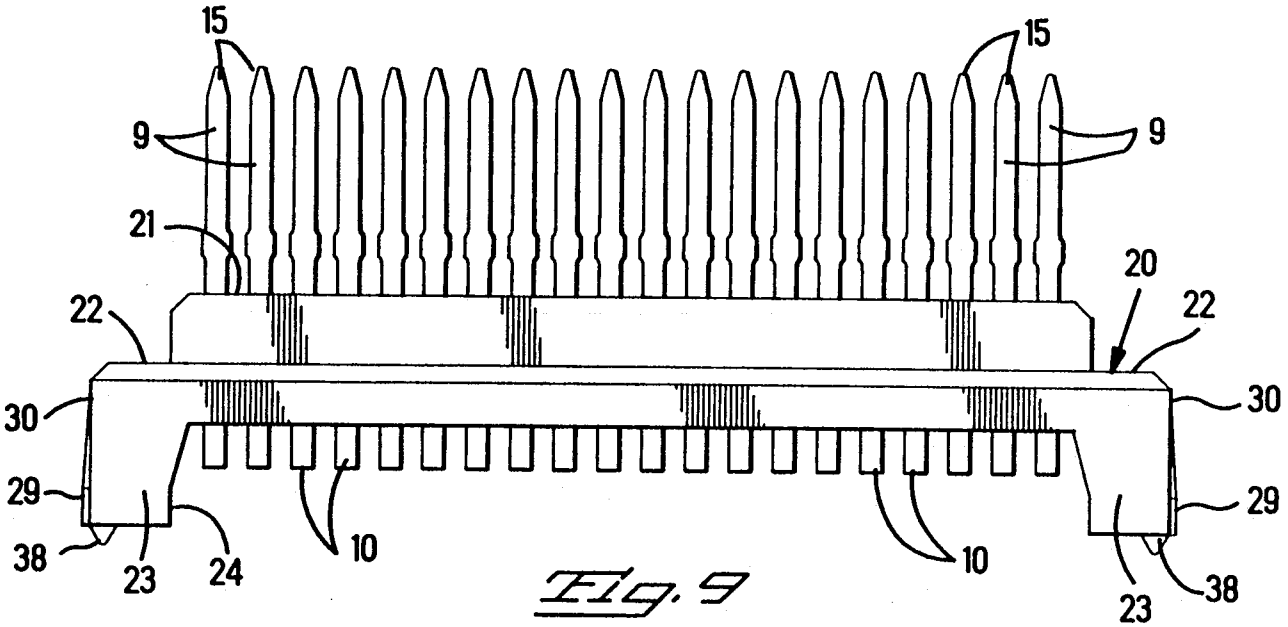
FIG. 9 is a rear elevation view of the structure shown in FIG. 5.
Figure 12:
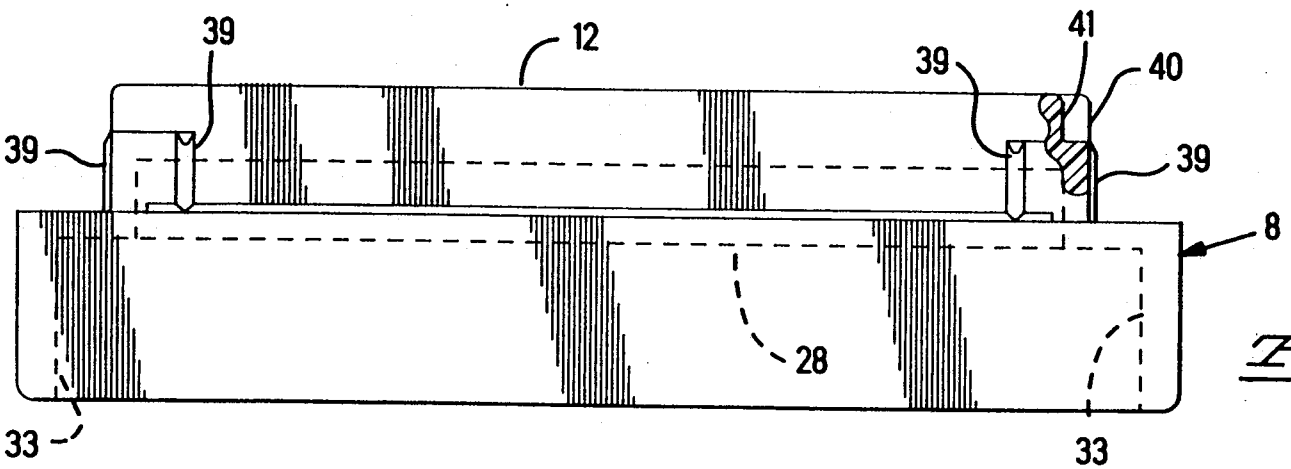
FIG. 12 is an elevation view of a housing.
Figure 14:
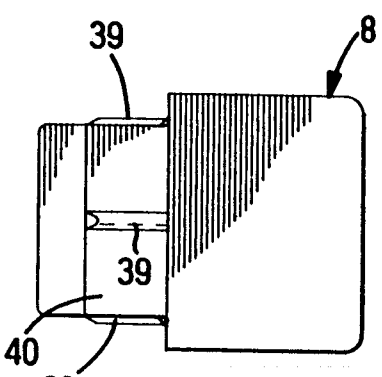
FIG. 14 is an end view of the housing shown in FIG. 13.

As shown in FIGS. 8 and 9, each contact 9 is of unitary construction and includes an electrical contact portion in the form of an elongated pin 15. Alternatively, the contact portion can be a receptacle, not shown. The wire connecting portions 10 of the contacts 9 are strips of narrow widths to achieve or approach impedance matching, whereby the impedance along the strips is the same as, or nearly the same as, the impedance of the cable 2 along the signal wires 4.

To facilitate assembly of the signal wires 4 to the contacts 9, the wire connecting portions 10 of the contacts 9 are arranged in an order wherein, the wire connecting portions 10 are in a row and are in a corresponding plane for connection to corresponding signal wires 4 of the cable 2. The wire connecting portions 10 are spaced apart on a pitch spacing correspondingly the same as the pitch spacing of the spaced apart signal wires 4. The signal wires 4 are cut to a common length, simultaneously overlaid upon the coplanar wire connecting portions 10 of the contacts 9 and are connected to the wire connecting portions 10 in one joining operation, for example, by welding or soldering. Wire connections of the signal wires 4 are formed by the joining operation.

With reference to FIG. 4B, a signal wire 4 and a tab 14 are connected to the same wire connecting portion 10 of a corresponding ground contact 9', and further are connected to each other by the joining operation. The signal wire 4 is placed to overlie both the tab 14 and the wire connecting portion 10 and is simultaneously connected thereto by the joining operation. Thereby, the signal wire 4 is selected to conduct the ground potential along the cable 2.

FIG. 4B discloses the ground wires 5 comprising shorter wires of the cable 2. The shorter, ground wires 5 extend to the wire connecting portions of the ground bus 7 located in a first plane. Further, FIGS. 4B and 19 disclose the signal wires 4 comprising longer wires of the cable 2. The longer, signal wires 4 are spaced from the first plane and extend past the wire connecting portions of the bus 7 in the first plane, and extend to the wire connecting portions 10 of corresponding contacts 9. The wire connecting portions 10 of the contacts 9 are in a second plane, different from the first plane.

With reference to FIGS. 3 and 3A, fabrication of the signal contacts 9 will be described. A unitary strip of the conductive signal contacts are in a row along a carrier 16. Unitary webs 18 bridge between adjacent signal contacts 9. The strip is stamped from a strip of metal. Each of the signal contacts 9 has an offset 19 in its plane of thickness. The signal contacts 9 are in a common plane defined by their thicknesses. Each of the signal contacts 9 extends straight from front to rear along pitch spacings equal to the pitch spacings of the signal contacts 9 of one row in the cable assembly 1, FIG. 2.

The row of signal contacts 9 are held by an insulative housing block 20, FIGS. 5, 6, 7 and 9. The housing block is 20 unitary and is formed by injection molding fluent plastics material, which when solidified imbeds the signal contacts 9, leaving exposed the carrier 16 and the webs 18. The carrier 16 and the webs 18 are severed and removed when the signal contacts 9 are held immobile by the housing block 20. The carrier 16 is illustrated in phantom outline in FIG. 5, to show its location prior to removal.

The housing block 20 includes a front wall 21 projecting forward of front facing shoulders 22, 22 and end walls 23, 23 extending rearward of the shoulders 22, 22. The signal contacts 9 project longitudinally forward from the front wall 21. With reference to FIGS. 8 and 9, a row of the wire connecting portions 10 of the spaced apart signal contacts are in a rear facing cavity 24 extending between the spaced apart end walls 23, 23. The signal contacts 9, the ground bus 7 and the wires 4, 5 are connected as described above, and as disclosed in U.S. Pat. No. 4,834,674.

Two duplicate housing blocks 20, 20 are assembled together, FIG. 19. Duplicate housing blocks 20, 20 are attached together in the following manner. One of the end walls 23 includes a projecting peg 25. The other of the end walls includes a recessed socket 26. The peg 25 and the socket 26 extend transversely of the plane of the signal contacts 9 and toward a duplicate housing block 20 that holds the second row of signal contacts 9. The pegs 25 of the respective housing blocks 20, 20 are received in corresponding sockets 26 of the respective housing blocks 20, 20. The offsets 17, 17 of the corresponding ground busses 7, 7 offset the ground busses 7, 7 toward and against each other, whereupon they are joined together, for example, by weld or solder, for connection to a common electrical ground potential by way of a corresponding ground contact 9'.

Fluent plastics material 27, illustrated by stippling in FIG. 19, is cast in place in the corresponding cavities 24, 24 that face each other to fill spaces between the wires 4,5 and to cover the open ends of the cavities 24, 24 at the rear of the housing blocks 20, 20. Thereafter, the plastics material 27 is solidified to fix the wires 4,5 in place. The plastics material 27 solidifies and retains the embedded portion 6 of the cable 2.

Figure 10:
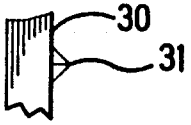
FIG. 10 is a fragmentary enlarged view of a portion of FIG. 6.
Figure 11:
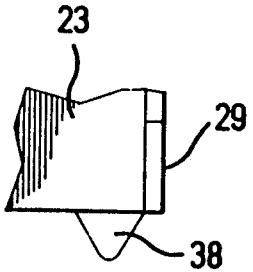
FIG. 11 is a fragmentary enlarged view of a portion of FIG. 5.
Figure 16:
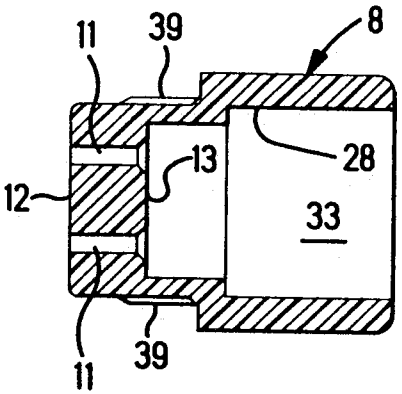
FIG. 16 is a section view taken along the line 16—16 of FIG. 13.
Figure 13:
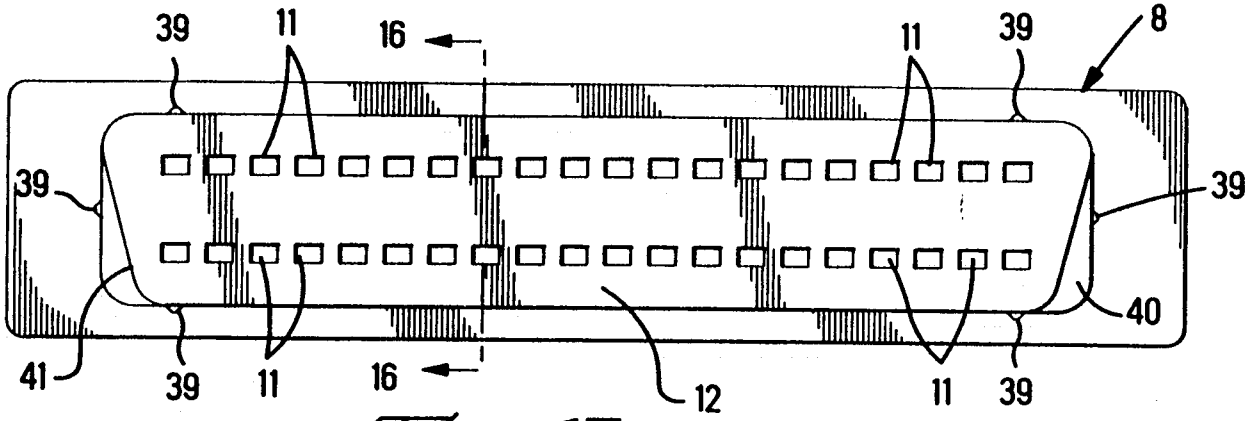
FIG. 13 is a top plan view of the housing shown in FIG. 12.
Figure 15:
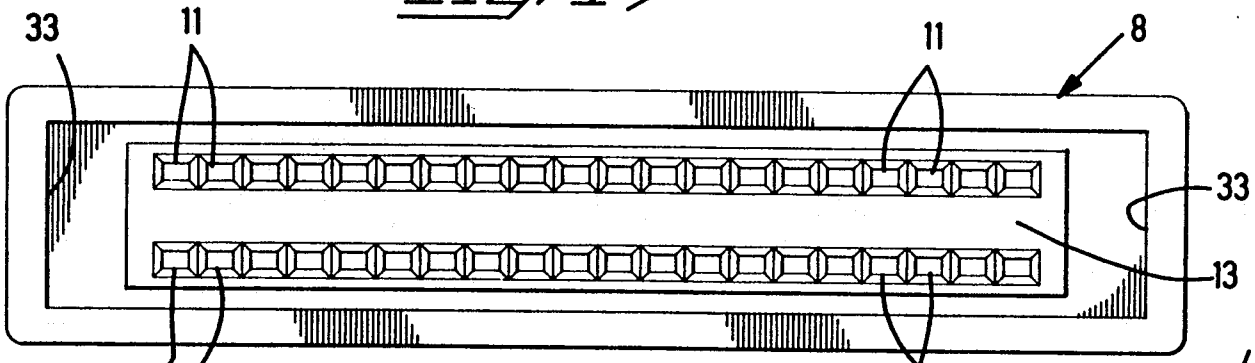
FIG. 15 is a bottom plan view of the housing shown in FIG. 12.
Figure 18:
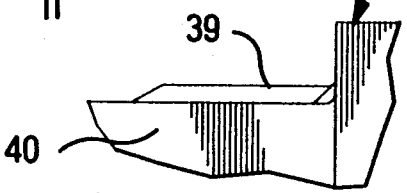
FIG. 18 is a fragmentary enlarged view of a portion of the housing shown in FIG. 14.
Figure 17:
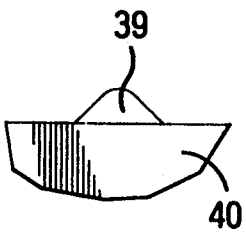
FIG. 17 is a fragmentary enlarged view of a portion of the housing shown in FIG. 13.

The duplicate housing blocks 20, 20 are then inserted into a rear facing cavity 28 of the housing 8, FIGS. 16 and 19. Each of the housing blocks 20 includes a rib 29 projecting along a corresponding side 30 of a corresponding end wall 23. Each rib 29 is sloped to a ridge 31 along the length of the rib 29, FIGS. 6 and 10, and tapers in thickness from the rear and forward toward a point 32, FIG. 7. These ribs 29, 29 form an interference fit against opposite interior sides 33, 33 of the cavity 28. The duplicate housing blocks 20, 20 are frictionally held in the cavity 28 by the interference fit, while the major exterior surfaces of the housing blocks 20, 20 are dimensioned for generous dimensional clearances within the cavity 28. The contacts 9 project forward through the front wall 12 of the housing 8 and along corresponding cavities 11.

With reference to FIGS. 1 and 2 the front wall 12 of the housing 8 has a familiar D shaped outer circumference, and is inserted in a drawn conductive inner shell 34 that has a familiar D shaped outer circumference. The inner shell 34 and the housing 8 are then assembled in an encircling, bipartite, conductive back shell 35 having pivotally mounted latch arms 36, 36. The back shell 35, the inner shell 34 and the housing 8 are disclosed in U.S. Pat. No. 4,781,615, except that the housing 8 is altered from the plug housing disclosed in the patent to form the housing 8, as described herein, and the backshell 35 is altered with a cable entry to fit over the cables 2, 2 exiting one hundred eighty degrees from a mating face 37 of the cable assembly 1. The latch arms 36 are fabricated and assembled to the back shell 35 as disclosed in U.S. Pat. No. 4,842,542. Rearward extending protrusions 38, 38, FIGS. 5, 7, 8, 9 and 11, project rearward from corresponding end walls 23, 23 of the corresponding housing block 20. The protrusions 38, 38 project outward of a rear of the housing 8. The protrusions 38, 38 engage the backshell 35 as disclosed in U.S. Pat. No. 4,781,615 in an interference fit to position the housing 8 therein, to clamp the inner shell 34 in engagement with the backshell 35 and establish electrical continuity therebetween, and to assure positioning of the inner shell 34 to project forwardly of the back shell 35.

Additional ridges 39 are spaced along the circumference of the front wall 12 along a rectangular section 40 rearward of the D shaped circumference 41. These ridges extend front to rear and form an interference fit against opposite interior walls, not shown, of the inner shell 34. The exterior surfaces of the circumferences of sections 40 and 41 are then provided with generous dimensional clearances with the interior walls of the inner shell 34.

The wires 4, 5, the wire connecting portions 10 of the contacts 9 and the wire connecting portions of the ground busses 7, 7 are encapsulated in the insulative material 27 and are within the cavities 24, 24 of the corresponding housing blocks 20, 20. The selected contacts 9' are insulated from the signal contacts 9 and from the back shell 35 and the inner shell 36. Thereby, the ground busses 7, 7 are isolated electrically from the backshell 35 and from the electrical potential of the chassis, known as chassis ground potential. The ground potential of the ground busses 7, 7 is known as floating ground potential, since it can be different from chassis ground potential. The ground bus 7 is enclosed by the conductive shell 35 and isolated electrically from the shell 35, and the ground wires 4 extend into the shell 35 and are isolated electrically from the shell 35.

What is claimed is:

1. A cable assembly for at least one electrical cable comprising: an insulative housing block, conductive electrical contacts in the housing block connected to corresponding signal wires of the cable, a conductive ground bus connected to corresponding ground wires of the cable, plastics material at a rear of the housing block imbedding the electrical contacts and the ground bus and a portion of the cable, an insulative housing having a rear facing cavity receiving the housing block and the contacts and the plastics material, the housing having contact receiving cavities receiving corresponding contacts, a conductive shell enclosing the housing and connected to chassis ground potential, the ground bus being enclosed by the conductive shell and being isolated electrically from the shell by the plastics material in the housing, and the ground wires extending into the shell and being isolated electrically from the shell by the plastics material in the housing.

2. A cable assembly as recited in claim 1, comprising: longer wires of the cable being connected to the wire connecting portions of the contacts, the ground bus being selectively connected by tabs with selected wire connecting portions of corresponding contacts to project the ground bus in a first plane offset away from a second plane containing the wire connecting portions of the contacts.

3. A cable assembly as recited in claim 1, comprising: wire connecting portions of a bus bar and of the contacts are spaced apart on the pitch of the wires.

4. A cable assembly as recited in claim 1, comprising: exterior ribs on the housing block engaging opposite interior walls of the housing with an interference fit.

5. A cable assembly as recited in claim 1, comprising: protrusions on the housing block projecting outward of the housing to engage the shell.

6. A cable assembly as recited in claim 1, comprising: ridges on the housing rearward of a D shaped circumference on a front wall of the housing and forming an interference fit with a conductive interior shell engaging the first recited shell.

7. A cable assembly as recited in claim 1, wherein the plastics material is solidified and imbeds the contacts and the ground bus and said portion of the cable before being received in the rear facing cavity of the housing.

8. A cable assembly as recited in claim 1, wherein the plastics material is solidified and imbeds the contacts before the contacts are received by said contact receiving cavities.

* * * * *